United States Patent [19]

Lohr

[11] 3,970,311

[45] July 20, 1976

[54] IMPACT GUN WITH PELLET POSITIONING LEVER

[76] Inventor: Raymond J. Lohr, 5043 Sterrettania Road, Erie, Pa. 16506

[22] Filed: Nov. 12, 1975

[21] Appl. No.: 631,105

[52] U.S. Cl. ..... 273/101; 273/1 M; 46/238; 124/41 R

[51] Int. Cl.[2] ..... A63F 9/02

[58] Field of Search ..... 46/238, 239; 273/1 M, 273/95 R, 101, 32 F

[56] References Cited

UNITED STATES PATENTS

| | | | |
|---|---|---|---|
| 3,653,662 | 4/1972 | Welbourn | 273/1 M |
| 3,734,502 | 5/1973 | Bolton | 273/1 M |
| 3,845,957 | 11/1974 | Lohr | 273/101 |

FOREIGN PATENTS OR APPLICATIONS

| | | | |
|---|---|---|---|
| 501,523 | 11/1954 | Italy | 273/32 F |

*Primary Examiner*—Richard C. Pinkham
*Assistant Examiner*—Marvin Siskind

[57] ABSTRACT

A target game is disclosed in the form of a box with the front wall made of a resilient clear plastic. The box may contain various rotating and spinning targets located toward the rear wall of the box. A single pellet normally rolls forward down the inclined bottom and rests on the bottom at the center of the front wall. The pellet can be picked up by a wand or lever which protrudes through the top of the box in such a way that the operator can grasp the upper end of the handle of the wand, pick up the pellet and move it to the inner face of the clear plastic wall into line with the target. The muzzle of a small pistol or other impacting means can be placed against the clear plastic opposite the pellet to deliver a sharp blow to the front of the plastic wall, propelling the pellet toward the target.

5 Claims, 5 Drawing Figures

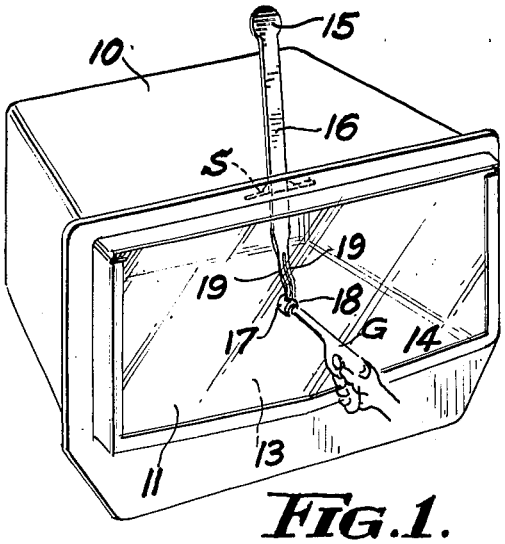
FIG. 1.
FIG. 2.
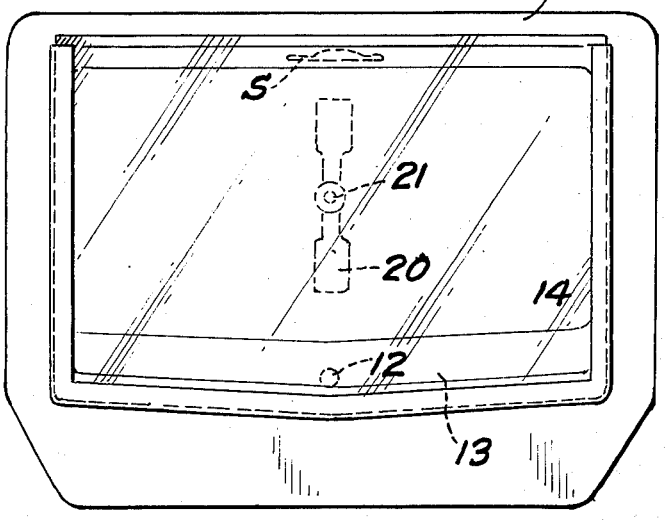
FIG. 3.
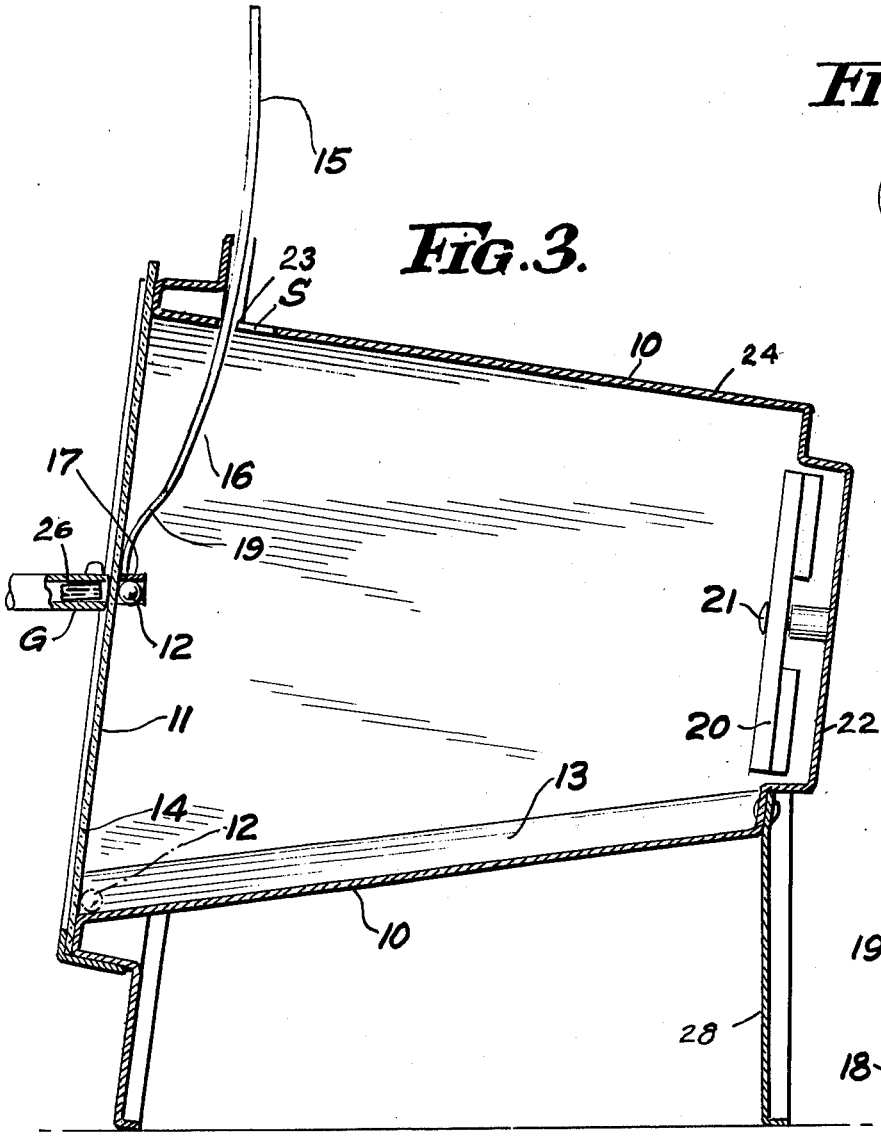
FIG. 4.
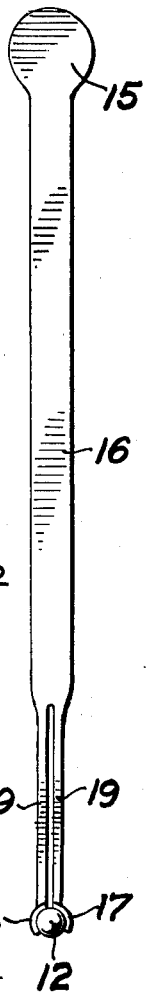
FIG. 5.
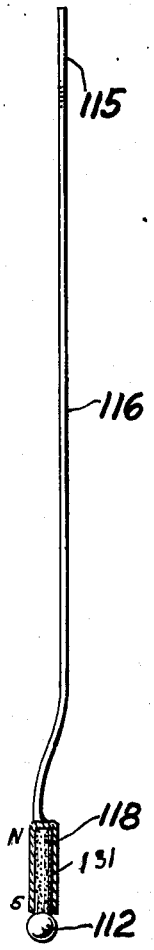

IMPACT GUN WITH PELLET POSITIONING LEVER

REFERENCE TO PRIOR ART

The game disclosed herein constitutes an improvement over U.S. Pat. Nos. 142,625 to Nelson, 2,636,738 to Abagosf, U.S. Pat. No. 2,830,569 to Sakuta.

OBJECTS OF THE INVENTION

It is an object of the invention to provide an improved game.

Another object of the invention is to provide a target game that is simple in construction, economical to manufacture and simple and interesting to play.

With the above and other objects in view, the invention consists of the combination and arrangement of parts hereinafter more fully described, illustrated in the accompanying drawings and more particularly pointed out in the appended claims, it being understood that changes may be made in the form, size proportions, and minor details of construction without departing from the spirit or sacrificing any of the advantages of the invention.

GENERAL DESCRIPTION OF DRAWINGS

FIG. 1 is an isometric view of the target game according to the invention.

FIG. 2 is a front view of the game.

FIG. 3 is a longitudinal cross sectional view of the game according to the invention.

FIG. 4 is an enlarged view of the lever or handle for lifting the pellet according to the invention.

FIG. 5 is a view, partly in cross section of another embodiment of the invention.

DETAILED DESCRIPTION OF DRAWINGS

Now with more particular reference to the drawings, a target game is made up generally of a box-like structure 10 having a front wall 11 made up of a resilient clear plastic sheet. The front wall 11 may be thin plexiglass, any suitable transparent sheet or other transparent material. The box may be a closed container. The rear wall 22 supports the rotating target 20 on the axle 21. The target is so constructed that it will spin or rotate when it is impacted by the pellet 12. The target could be supported on an axle oriented parallel to the lateral or longitudinal axes of the box, knock down, bell, counting or registering, or could be a target of any other form, depending on the taste of the designer.

Where a magnet is used on the wand, the pellet 12 is made of a ferrous material, when the wand of FIG. 4 is used, the pellet 12 could be plastic, brass or other material. The pellet normally rests on the bottom 13 of the box, which is inclined toward the front so that the pellet always rolls down, toward the front of the box by gravity.

The wand or lever 16 has a handle 15 and the lever 16 can project down through an opening 23 in the top wall 24 of the box. The lever is sufficiently long to reach the pellet 12 resting on the bottom of the box.

The operator can move the lever down until the bifurcated legs 19 of the lever are spread laterally sufficient to engage the pellet 12 between the ends 17 and 18. The pellet is then held by friction between the ends 17 and 18 and can be lifted to the position shown in FIG. 3, with the pellet 12 in contact with the sheet 11. The gun 25 can then be aimed at a particular point on the target supported on the spinning wheel 20 and when the trigger of the gun is pulled, a rod 26 inside the gun will be propelled forward to give a sharp rap against the clear plastic sheet 11 directly opposite the pellet 12. The pellet will thus be projected toward the target and, if properly aimed, it may strike the intended point on the target.

The gun 25 will be of the type shown in U.S. Pat. No. 3,845,957 or any other suitable gun having a suitable projectile like member that can strike the clear plastic material. The box is preferrably supported on front legs 27 and rear legs 28 which may be supported on a suitable surface.

The lower legs 19 of the lever 16 may be molded integral with the lever of a suitable plastic material such as polyethlene, vinyl polystyrene or any other suitable plastic materials or it could be made of wood or metal. The ends 17 and 18 will be of suitable contour to lightly grasp the pellet 12 and hold it in position. The spinning target 20, supported on the axle 21, could be supported on an angle disposed at 90° to the axle shown. The axle can extend from one side of the inside wall 30 of the box to the other side wall 31. It could be supported from the rear wall in an L-shape, according to the taste of the designer.

In the embodiment of the invention shown in FIG. 5, a lever is shown with a hand engaging part 115 and a permanent magnet 118 supported in the bottom of the lever. The magnet 118 can be inserted in the hollow 131 in the lever or otherwise supported. The magnet will be provided with north and south poles, which could be oriented in any desired manner that would project a magnetic field to support the pellet.

The foregoing specification sets forth the invention in its preferred practical forms but the structure shown is capable of modifications withing a range or equivalents without departing from the invention which is to be understood is broadly novel as is commensurate with the appended claims.

The embodiments of the invention in which an exclusive property or privilege is claimed are defined as follows:

1. A target game comprising an enclosed container having a front wall, said front wall comprising a resilient transparent sheet, a rear wall on said container, rotatable target means supported adjacent said rear wall, a pellet, said pellet normally resting against said front wall adjacent the lower side thereof, a top wall having an opening therethrough, a lever, said lever projecting through the opening in said top wall and being of sufficient length to extend down to the bottom of said container, means on said lever for lifting and locating said pellet on the inner side of said front wall, a gun means adapted to be supported against said front wall, opposite said pellet said gun means transmitting force through said front wall against said pellet, whereby said pellet can be projected toward said target upon firing said gun.

2. The game recited in claim 1 wherein said gun means comprises, a rod means in said gun and spring means propelling said rod means toward said target for impacting said front wall opposite said target.

3. The game recited in claim 1 wherein said means on said lever for lifting said pellet comprises, a permanent magnet and said pellet is made of ferrous material.

4. The game recited in claim 1 wherein said container has a bottom having a top surface inclined toward said front wall whereby said pellet can roll toward said front wall.

5. The game recited in claim 1 wherein said means on said lever for lifting said ball comprises two spaced legs integrally attached to said lever, said legs having means thereon for recovering said ball therebetween.

* * * * *